US009180363B2

(12) United States Patent
Schofield et al.

(10) Patent No.: US 9,180,363 B2
(45) Date of Patent: Nov. 10, 2015

(54) ENVIRONMENTAL GAME WITH ARTIFICIAL INTELLIGENCE

(71) Applicants: Kathleen Schofield, Phelps, WI (US); Tallea Doppke, Phelps, WI (US); William Gardinier, Phelps, WI (US)

(72) Inventors: Kathleen Schofield, Phelps, WI (US); Tallea Doppke, Phelps, WI (US); William Gardinier, Phelps, WI (US)

( * ) Notice: Subject to any disclaimer, the term of this patent is extended or adjusted under 35 U.S.C. 154(b) by 66 days.

(21) Appl. No.: 14/076,868

(22) Filed: Nov. 11, 2013

(65) Prior Publication Data

US 2015/0133222 A1 May 14, 2015

(51) Int. Cl.
*A63F 9/24* (2006.01)

(52) U.S. Cl.
CPC ..... *A63F 9/24* (2013.01); *A63F 2009/2432* (2013.01); *A63F 2009/2475* (2013.01)

(58) Field of Classification Search
CPC ..... A63F 9/24; A63F 2009/2432; A63F 2009/2475
USPC ..... 463/1
See application file for complete search history.

(56) References Cited

U.S. PATENT DOCUMENTS

| | | | | |
|---|---|---|---|---|
| 5,088,739 | A * | 2/1992 | Mitchell | 273/248 |
| 5,366,227 | A * | 11/1994 | Duffy | 273/287 |
| 2002/0182572 | A1 * | 12/2002 | Steurenthal | 434/219 |
| 2004/0197753 | A1 * | 10/2004 | Kirsch | 434/237 |
| 2008/0234049 | A1 * | 9/2008 | LeBlanc et al. | 463/42 |
| 2013/0032999 | A1 * | 2/2013 | Hildebrand | 273/242 |
| 2013/0085585 | A1 * | 4/2013 | Griffen | 700/91 |

* cited by examiner

*Primary Examiner* — Corbett B Coburn
(74) *Attorney, Agent, or Firm* — Gulf Coast Intellectual Property Group

(57) ABSTRACT

A game operable to transform an area from a first state to a second state wherein the players interact with artificial intelligence. The game includes a method of play utilizing a game box wherein the game box is configured to store and receive a plurality of game components. An artificial intelligence module is disposed within the game box and is configured with software to recognize human speech and provide reactions thereto. The game includes at least two collection wands that are operable to assist a user in collecting objects from the defined game area. A plurality of bags are provided with at least a portion of the bags being transparent.

19 Claims, 3 Drawing Sheets

ENVIRONMENTAL GAME WITH ARTIFICIAL INTELLIGENCE

PRIORITY UNDER 35 U.S.C. SECTION 119(E) & 37 C.F.R. SECTION 1.78

This nonprovisional application claims priority based upon the following prior U.S. Provisional Patent Application entitled: Environmental Game, Application No. 61/726,133, filed Nov. 14, 2012, in the name of Kathleen Schofield, which is hereby incorporated by

FIELD OF THE INVENTION

The present invention relates generally to games, more specifically but not by way of limitation, an environmentally friendly game wherein the participants utilize the items of the game to recover trash from a particular area.

BACKGROUND

Millions of individual engage in various past times and hobbies in order to provide themselves enjoyment and or exercise. Participating in recreational sports is another means in which people choose to enjoy the outdoors. There are numerous types of games that are played outdoors that require various levels of skill and competency. Outdoor games such as horseshoes and others can provide hours of enjoyment.

One problem with conventional outdoor games is that they are not focused on producing a socially responsible output as a deliverable of the game. Most games provide enjoyment for the participants but they do not provide any collateral impact in areas such as but not limited to the environment. Actually, there are many outdoor games that have a negative impact on the environment as a result of the participants leaving trash or other items in the area where the game was played.

Another issue with many games is that most outdoor games can only be played by certain age groups. Many outdoor games require a certain amount of physical ability that either a younger person or an older person does not have therefore restricting that individuals ability to participate. While these types of games are enjoyable for those able to participate, they also exclude several segments of the population due to the physical requirements.

Accordingly, there is a need for an outdoor game that provides a positive environmental impact in the area in which the game is played and can be participated in by numerous age groups and types of people.

SUMMARY OF THE INVENTION

It is the object of the present invention to provide an outdoor game that facilitates the recovery of trash in the area in which the game is played.

Another object of the present invention is to provide an outdoor game that facilitates the recovery of trash during the method of play that requires at least two people to play.

A further object of the present invention is to provide an outdoor game that facilitates the recovery of trash that includes a content box that is approximately 12 inches by 21 inches and 4 inches deep that is used to store the game items of the game.

Yet another object of the present invention is to provide an outdoor game wherein the method of play is operable to facilitate the recovery of trash within a certain area wherein the content box is manufactured from a suitable durable material.

Still a further object of the present invention is to provide an outdoor game wherein the method of play facilitates the recovery of trash within an area that includes pairs of rubber gloves to protect the hands of the players.

An additional object of the present invention is to provide an outdoor game that has a positive environmental impact that includes two types of plastic bags wherein one plastic bag is transparent and the other type of plastic bag is non-transparent.

Another object of the present invention is to provide an outdoor game that has a positive environmental impact that includes brightly colored vest for the players to wear during the playing of the game.

An additional object of the present invention is to provide an outdoor game that further includes a hat or visor for each of the participants wherein the hat or visor is color-coordinated with at least one of the other game pieces or objects used by the player.

Yet another object of the present invention is to provide an outdoor game wherein the method of play facilitates the recovery of trash in an area that includes pickup sticks for use by the participants of the game.

Still another object of the present invention is to provide an outdoor game wherein the method of play facilitates the recovery of trash in an area wherein the pickup sticks include a sharp object at one end and a loop handle on the opposing end.

A further object of the present invention is to provide an outdoor game that facilitates the recovery of trash in a certain area that includes water bottles for the participants.

Yet a further object of the present invention is to provide an outdoor game wherein the method of play facilitates the recovery of trash wherein the game includes a starting point and an ending point.

An additional object of the present invention is to provide a game that provides a positive environmental impact by facilitating the recovery of trash in an area that includes pickup sticks in several different lengths.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the present invention.

BRIEF DESCRIPTION OF THE DRAWINGS

A more complete understanding of the present invention may be had by reference to the following Detailed Description when taken in conjunction with the accompanying Drawings wherein.

DETAILED DESCRIPTION

Figure 1:
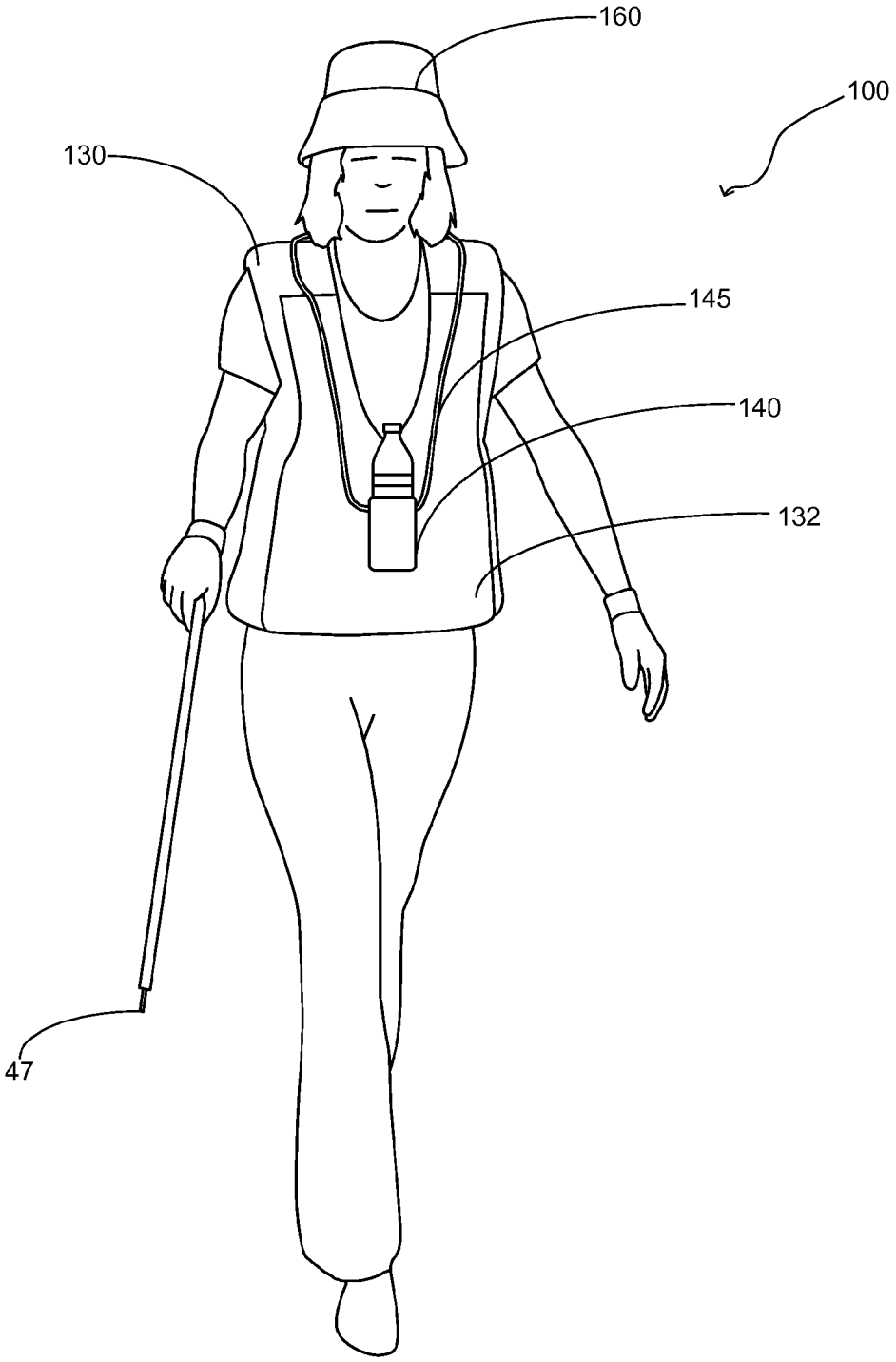
FIG. 1 is a perspective view of a portion of the invention that is worn by a user.

Referring now to the drawings submitted herewith, wherein various elements depicted therein are not necessarily drawn to scale and wherein through the views and figures like elements are referenced with identical reference numerals, there is illustrated an environmental transformation game 100 constructed according to the principles of the present invention.

Referring to the drawings herein, the environmental transformation game 100 further includes a game box 10. The game box 10 is generally rectangular in shape and is manufactured from a suitable durable material such as but not limited to word. The game box 10 is formed from a plurality of walls 12 and a bottom 14 so as to create an interior volume 16. The interior volume 16 is sufficient in size so as to receive and store the game components 20 therein. The interior volume 16 is divided into a plurality of storage compartments 25 as shown in particular in FIG. 2. The storage compartments 25 are sized in various sizes so as to accommodate the different sized game components 20. While no particular size for the game box 10 is required, good results have been achieved by utilizing a game box 10 that is approximately twelve inches in width, twenty one inches in length and four inches in depth.

Figure 2:
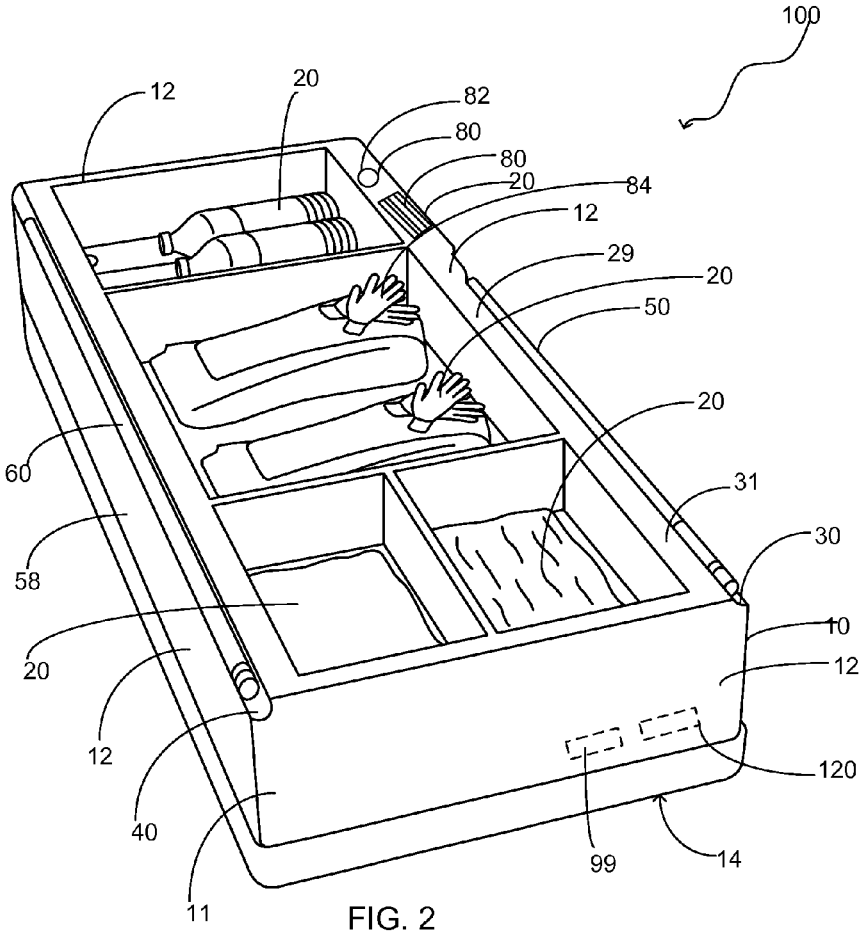
FIG. 2 is a perspective view of the storage compartment of the present invention.

Still referring in particular to FIG. 2, the game box 10 further includes a first groove 30 and a second groove 40. The first groove 40 is located proximate the top edge 31 of the front wall 29. The first groove 40 is generally arcuate in shape and is operable to mateably receive the first collection wand 50. The collection wand 50 is manufactured from a suitable durable material such as but not limited to wood and is generally elongated and cylindrical in shape. The collection wand 50 is manufactured having a diameter that is mateable with the radius of the first groove 30. The first groove 40 is formed such that it is approximately three-quarters the length of the front wall. 29. This length is desired as it accommodates the length of the first collection wand 50 and allows for the electronic components 80. The second groove 40 is integrally formed along the rear wall 58 of the game box 10 proximate the top edge 51. The second groove 40 is operable to mateable receive and secure the second collection wand 60. The second groove 40 extends substantially the length of the rear wall 58 and has an arcuate shaped bottom having a radius that is operable to facilitate the mateable receipt of the second collection wand 60. The second collection wand 60 is manufactured similar to the first collection wand 50 being generally elongated and cylindrical in shape and substantially rigid. While not particularly illustrated herein it is contemplated within the scope of the present invention that the first collection wand 50 and second collection wand 60 are covered with a coating that is highly luminescent. Furthermore, it is contemplated within the scope of the present invention that the first collection wand 50 and second collection wand 60 are coated in a material such as but not limited to a luminescent paint of at least two colors. This facilitates easy visibility of the first collection wand 50 and second collection wand 60 when in use and further serves to provide visual alerts to individuals proximate the players of the environmental transformation game 100.

Integrated into the front wall 29 are the electronic components 80. The electronic components 80 provide an interface and feedback form the artificial intelligence module 120. A microphone 82 is secured within the front wall 29 and is operable to receive audio signals from a user during a game. The microphone 82 is a conventional audio microphone and is operably coupled with the artificial intelligence module 120. The microphone 80 functions to receive audio signals from a user and transmit the audio signals to the artificial intelligence module 120 for interpretation as further discussed herein. A speaker 84 is further integrated into the front wall 29 of the game box 10. The speaker 84 is a conventional audio speaker that is operably coupled to the artificial intelligence module 120. The speaker 24 is operable to transmit audio signals to a user in the form of spoken instructions and or other audio signals during the play of the environmental transformation game 100.

An artificial intelligence module 120 is secured within the sidewall 11 as shown in FIG. 2 herein. The artificial intelligence module 120 includes the necessary electronic to store, receive, transmit, manipulate and interpret data received from the microphone 80. The artificial intelligence module 120 further includes software programmed therein that is operable to receive speech data from a user via the microphone 80 and interpret the speech data for use in providing game instructions and game results. More specifically but not by way of limitation, a user will utilize the first collection wand 50 to retrieve a piece of debris from the area in which the environmental transformation game 100 is being played. As the user collects the debris, the user will speak into the microphone 80 with the command "debris collected". The microphone 80 will transmit this command to the artificial intelligence module 120 wherein the module will interpret the speech command and reply with a signal to the speaker 84 with an inquiry, "what type of debris was collected". Ensuing the prompt of the debris collection type, the user will speak into the microphone 80 the type of debris collected by stating a command such as but not limited to, "aluminum can". Subsequent receipt of the signal regarding the debris collection type, the artificial intelligence module 120 will store the information for later broadcast to the user. It is contemplated within the scope of the present invention that the artificial intelligence module 120 is programmed to interpret a plurality of speech commands and provide responses thereto. A power supply 99 is secured within the sidewall 12 and is operably coupled to the artificial intelligence module 120, microphone 80 and speaker 84. While no particular power supply is required, good results have been achieved by utilizing a power supply that is manufactured from lithium ion batteries.

Figure 3:
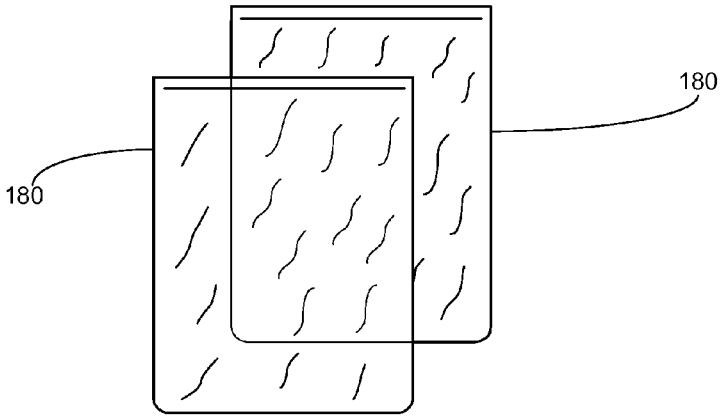
FIG. 3 is a side view of the bags of the present invention.

Referring in particular to FIG. 1, a user is shown wearing and holding the game components 20. A vest 130 is included and is worn during play of the environmental transformation game 100. The vest 130 is manufactured from a suitable durable material such as but not limited to nylon. The vest 130 further includes a reflective portion 132. The reflective portion 132 is operable to provide additional means for a user to be seen during their play of the environmental transformation game 100. It is contemplated within the scope of the present invention that the vest 130 could be provided in numerous different sizes. Furthermore it is contemplated within the scope of the present invention that the vest 130 is manufactured in numerous different bright colors. A water bottle 140 is provided with a lanyard 145. The water bottle 140 is a conventional drinking receptacle having a removable lid that that is operable to receive, store and dispense a liquid. The lanyard 145 is releasably secured to the water bottle 140 utilizing suitable durable techniques. The lanyard 145 is manufactured from a suitable durable material such as rope. Gloves 150 are provided to a player of the environmental transformation game 100. The gloves 150 are conventional gloves that are manufactured from a suitable durable material such as but not limited to leather. As previously discussed herein, the first collection wand 50 is shown in FIG. 1. The first collection wand 50 further includes a tip 47 that is operable to penetrate an object to be collected during the play of the environmental transformation game 100. The tip 47 is manufactured from a durable material such as but not limited to metal. A hat 160 is provided to each player of the environmental transformation game 100. While a particular style hat 160 is illustrated herein, it is contemplated within the scope of the present invention that the hat 160 provided could be numerous different styles of hats. As shown in FIG. 3, the environmental transformation game 100 includes a plurality of bags 180. The bags 180 are utilized to receive and retain objects that are collected during the play of the environmental transformation game 100. It is contemplated within the scope of the present invention that at least some of the bags 180 provided are transparent. The transparent bags 180 are operable to receive particular recyclable objects retrieved during the play of the environmental transformation game 100 such as but not limited to aluminum cans.

Figure 4:
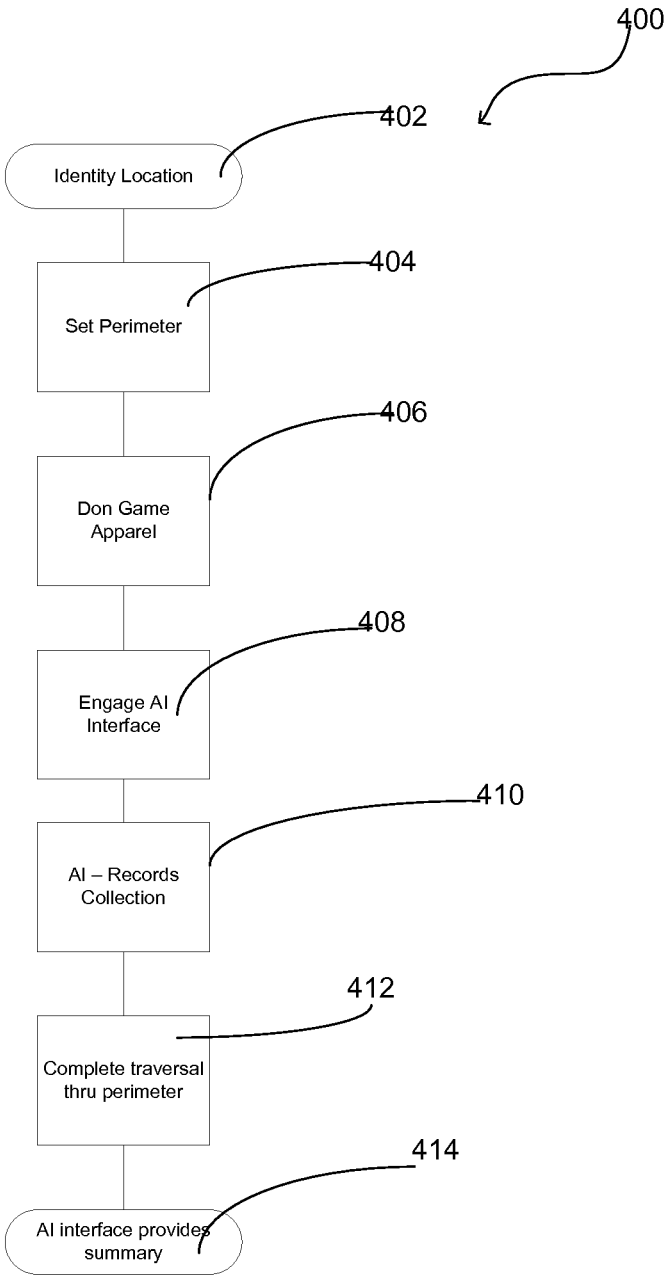
FIG. 4 is a flowchart of an exemplary method of play of the present invention.

Referring in particular to FIG. 4, a flowchart 400 outlining the method of play of the environmental transformation game 100 is illustrated therein. In step 402, a group of players being at least two people, will identify an area where the environmental transformation game 100 is to be played. The ideal location will be an area wherein there is at least some foreign debris that is not natural to the immediate area is present. By way of example but not by way of limitation, an area that is littered with trash is a good location for the environmental transformation game 100. In step 404, the users will set a perimeter within the identified area that defines the space in which the players will remain confined to during their play of the environmental transformation game 100. In step 406, the players will don the applicable game components 20 such as but not limited to the vest 130, hat 160 and gloves 150. One user will prepare the game box 10 for transport. It is contemplated within the scope of the present invention that the game box 10 could be transported using handles or other similar interfaces. A user will carry the game box 10 during the play of the environmental transformation game 100 in order to engage the artificial intelligence module 120. In step 408, the players begin collecting objects within the defined perimeter and begin interfacing with the artificial intelligence module 120. As previously discussed herein, the artificial intelligence module 120 includes the software to recognize and react to human speech. During the play of the environmental transformation game 100, each player will speak into the microphone 80 various commands such as but not limited to the type of debris collected. The artificial intelligence module 120 collects and stores the inputted information and further provides audio reaction to each input. The audio reaction is broadcast via the speaker 84 and can include such audio as confirmation of the type of debris and inquire as to how many of the type of debris was collected. It step 410, the artificial intelligence module 120 records the type of objects collected, the quantity of objects collected and which player collected the objects. In step 412, the players will complete their traversal through the defined perimeter of the area in which the environmental transformation game 100 is being played. In step 414, the artificial intelligence module 120 provides upon receiving request from a user via the microphone 80, a summary of each players performance and the objects collected by each object. During the play of the environmental transformation game 100, the area in which the game has been played has been transformed from an area that had non-native material and objects disposed therein, to an area that no longer contains non-native material.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A method of playing a game wherein the game is operable to transform an outside environmental area in which it is played from a first state of having a plurality of non-natural objects to a second state wherein the non-natural objects have been removed comprising the steps of:

providing game pieces, said game pieces operable to assist a player in playing the game, wherein the game pieces include a hat, a collection wand, gloves, at least one collection wand, a vest and a water bottle, said hat operable to be disposed on a players head, said vest operable to be place on a torso of a player, said at least one collection wand operable to facilitate the retrieval of the non-natural objects;

identifying an area in which the game will be played;

donning wearable game components;

recording game events, wherein the step of recording the game events includes the capture of the amount and type of non-natural material collected by each player;

traversing completely through the identified area;

collecting all of the non-natural material in the area in which the game is being played;

providing a game summary, wherein the game summary is broadcast to the players a module disposed within a game box.

2. The method as recited in claim 1, and further including inputting a player's identity, said inputting a player's identity being executed by each player announcing their name to the module.

3. The method as recited in claim 2, and further including the step of inputting a non-natural material type and quantity, said inputting a non-natural material type and quantity being entered via a voice command from a user.

4. The method as recited in claim 3, wherein the game box further includes a microphone and a speaker integrated thereinto, said speaker for emitting audio instructions, said microphone operable to receive voice commands.

5. The method as recited in claim 4, and further including the step of providing a plurality of bags, said plurality of bags being operable to receive and store the non-natural material collected during play of the game.

6. The method as recited in claim 5, wherein the game box further includes at least on groove, said at least one groove being operable to releasably secure the at least one collection wand.

7. A method of playing a game wherein the game is operable to transform an outside environmental area in which the game is played from a first to a second state wherein non-natural objects are removed during the play of the game and players of the game interface with an module operable to receive and interpret verbal instructions from the player comprising the steps of:

providing a plurality of game pieces, said game pieces operable to assist a player in playing the game, said game pieces including a game box, said game box having an module therein, said game box further including at least one pair of gloves, a vest and a hat and two collection wands;

identifying an area in which the game will be played;

selecting the desired game pieces, wherein each player will select from the plurality of game pieces;

donning wearable game components, said wearable game components being a hat, a vest and at least one pair wherein the players will don the wearable game pieces;

engaging the module of the game, wherein the module is disposed within a game box, said engaging the module being engaged via voice commands;

recording game events, wherein the step of recording the game events includes the capture of the amount and type of non-natural objects collected by each player;

traversing completely through the area in which the game is being played;

collecting all of the non-natural objects in the area in which the game is being played;

providing a game summary, wherein the game summary is broadcast to the players by the module.

8. The method of playing a game as recited in claim 7, and further including the step of entering player's names, said step of entering player's names being executed via a voice command to the module.

9. The method of playing a game as recited in claim 8, wherein said module is programmed with software operable to recognize human speech and provide responses thereto.

10. The method of playing a game as recited in claim 9, and further including the step of providing a plurality of bags, wherein at least a portion of said plurality of bags are manufactured from a transparent material.

11. The method of playing a game as recited in claim 10, wherein the game box includes an front wall and a rear wall, said front wall and said rear wall having a groove therein, said groove being operable to releasably receive said two collection wands.

12. The method of playing a game as recited in claim 11, and further including a microphone, wherein the microphone is operably coupled to the module, said microphone operable to transmit voice inputs to the module.

13. The method of playing a game as recited in claim 12, and further including the step of transforming an area, said step of transforming an area being accomplished by removing all non-natural objects from the area.

14. A method of playing a game wherein the game is operable to transform an outside environmental area in which it is played from a first to a second state wherein non-natural objects are removed during the play of the game and players of the game interface with a module operable to receive and interpret verbal instructions from the player comprising the steps of:

providing a plurality of game pieces, said game pieces operable to assist a player in playing the game, said game pieces including a game box, said game box operable to store bags therein, said game box having a module therein, said game box further including at least one pair of gloves, a vest and a hat and two collection wands;

identifying an area in which the game will be played;

selecting the desired game pieces, wherein each player will select from the plurality of game pieces;

donning wearable game components, wherein the players will don the wearable game pieces, said wearable game pieces being a hat, a vest and at least one pair of gloves;

entering the player's names, said step of entering the player's names being executed via voice command to the module;

engaging the module of the game, wherein the module is disposed within a game box, said engaging the module being engaged via voice commands;

providing object collection information, wherein each player speaks to the artificial intelligence module to provide information concerning the type and quantity of an object collected;

recording game events, wherein the step of recording the game events includes the capture of the amount and type of non-natural objects collected by each player;

traversing completely through the area in which the game is being played;

collecting all of the non-natural objects in the identified area;

providing a game summary, wherein the game summary is broadcast to the players by the module.

15. The method of playing the game as recited in claim 14, and further including the step of transforming an area, said step of transforming an area being accomplished by removing all non-natural objects from the area in which the game has been played.

16. The method of playing the game as recited in claim 15, wherein the game box includes an front wall and a rear wall, said front wall and said rear wall having a groove therein, said groove being operable to releasably receive said two collection wands.

17. The method of playing the game as recited in claim 16, and further including the step of providing a plurality of bags, wherein at least a portion of said plurality of bags are manufactured from a transparent material, said plurality of bags being operable to receive and store the non-natural objects.

18. The method of playing the game as recited in claim 17, wherein the game box is divided into a plurality of compartments, said plurality of compartments being operable to receive and store game components.

19. The method of playing the game as recited in claim 18, wherein the step of providing a plurality of game pieces further includes providing at least one water bottle, said at least one water bottle operable to store a liquid for consumption by a player.

* * * * *